United States Patent [19]

Saunders

[11] Patent Number: 4,563,821

[45] Date of Patent: Jan. 14, 1986

[54] PEEP SIGHT FOR COMPOUND BOW

[75] Inventor: Charles A. Saunders, Columbus, Nebr.

[73] Assignee: Saunders Archery Co., Columbus, Nebr.

[21] Appl. No.: 666,771

[22] Filed: Oct. 31, 1984

[51] Int. Cl.[4] ..... F41G 1/00

[52] U.S. Cl. ..... 33/265

[58] Field of Search ..... 33/265; 124/24 R, 87

[56] References Cited

U.S. PATENT DOCUMENTS

| | | | |
|---|---|---|---|
| 3,859,733 | 1/1975 | Chesnick | 33/265 |
| 4,116,194 | 9/1978 | Topel | 33/265 X |
| 4,134,383 | 1/1979 | Flood | 124/87 X |

*Primary Examiner*—Harry N. Haroian

*Attorney, Agent, or Firm*—Trexler, Bushnell & Wolters, Ltd.

[57] ABSTRACT

A bow-string mounted, self-aligning, positively positioned peep sight for a compound bow. The body of the peep sight includes a plurality of posts extending therefrom and about which divided strands of the bow string are laced or woven for selectively positioned securement of the peep sight in place. A peep sight hole is formed as a sighting port extending through the body of the peep sight. A bow sight aligner distinct from the string-mounted bow sight is secured to the bow string and connected by means of a tensioning band to a straight cable segment of the compound bow, whereby when the bow string is drawn, the band is tensioned and acts upon the bow string positively and reproducibly physically to orient the peep sight mounted thereon so that the sighting path through the peep sight bears directly on and aligns precisely with a longitudinal axis of an arrow held in the drawn bow.

18 Claims, 19 Drawing Figures

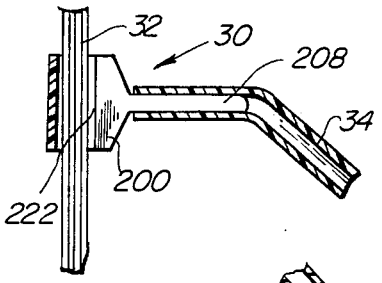
FIG. 3
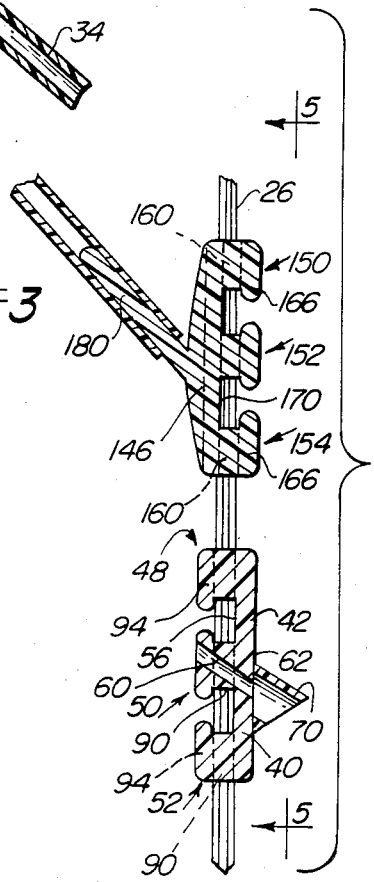
FIG. 4
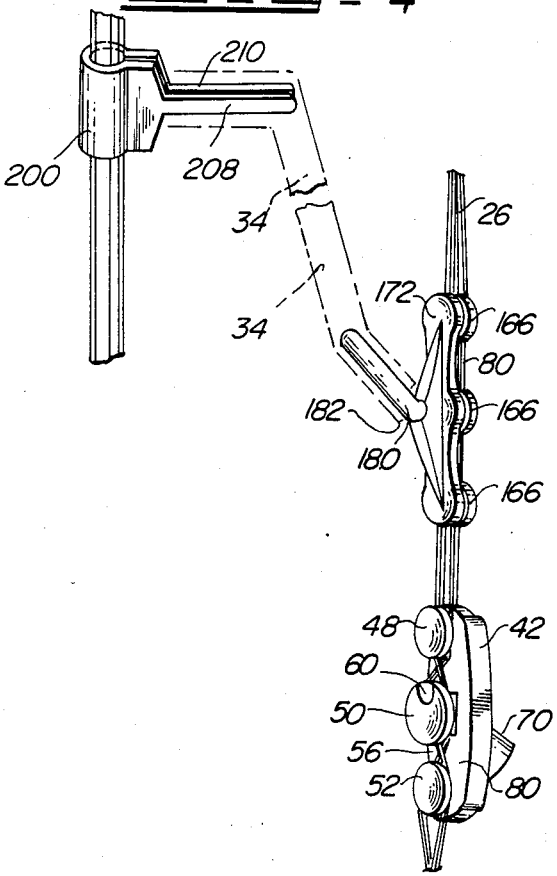
FIG. 5
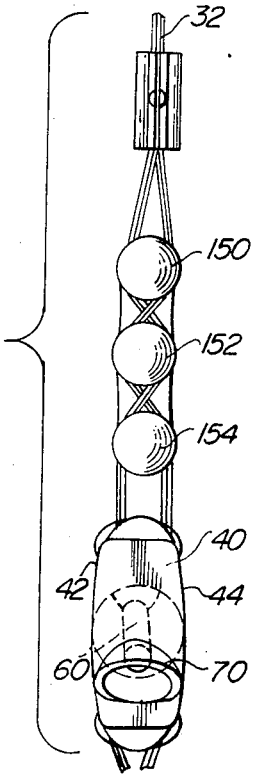
FIG. 6
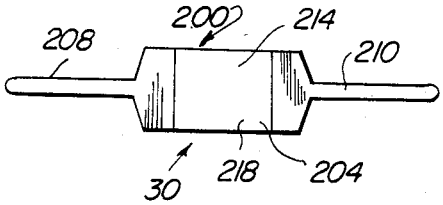

PEEP SIGHT FOR COMPOUND BOW

BACKGROUND OF THE INVENTION

The present invention relates, generally, to a peep sight for archery use. More particularly, the invention is directed to a peep sight for use on a compound bow, and optionally, in conjunction with a bow sight mounted on the bow itself.

The precision and the accuracy in the use of archery equipment, including compound bows, has been markedly improved through the utilization of the combination of a string-mounted peep sight in conjunction with a bow-mounted bow sight. Bow-mounted bow sights of various forms and structural features are known in the prior art. However, none of these structures is, specifically, an element of the present invention and, accordingly, no detailed description of any particular preferred bow sight is contained herein. Rather, it is contemplated and intended that the peep sight of the present invention will find utility with all bow mounted bow sights, and will be useful even without bow sights.

The established practice in the drawing of a bow is to affix the arrow at what is known as the nocking point on the bow string and to draw the bow string back a predetermined distance and with one's sighting eye at a fixed height above the nocking point. The goal of the archer is to utilize the described procedure as a means for releasing the arrow with a trajectory so that the arrow hits the target. The cause of the obvious difficulty is in ensuring that the sighting or aiming eye is always at the same and at the desired height above the nocking point. The use of auxiliary sighting devices such as peep sights has become commonplace. Such peep sights are secured onto the bow string at an elevational point above the nocking point and corresponding to the predetermined height which the archer has established as being the desirable height at which the aiming eye is located at the moment the bow is fully drawn. A bore extending through the body of the peep sight is then brought into alignment with the particular desired reference element of the bow-mounted bow sight, thereby establishing a viewing direction which is, ideally, correlated with the desired trajectory of the arrow upon its release from the bow.

One of the problems which has plagued the user of peep sights is that, being secured to a multiple stranded bow string, the peep sight tends to shift annularly about the bow string as the bow string is drawn. Such undesirable rotation, if present even in a slight amount, renders it impossible to achieve an alignment of the bore or sighting port of the peep sight with the reference point of the bow-mounted bow sight. That is, it is most difficult to ensure that the sighting bore through the peep sight extends in a plane which parallels the axis of the arrow itself. Various procedures and physical modifications of the peep sight itself have been used in an effort to solve the problem described. For example, in some instances the diameter of the viewing bore in the peep sight has been enlarged so as to accommodate a misaligning twisting of the bow string. It will be appreciated that such an approach to dealing with the problem inherently has the result of reducing precision and accuracy, and does not constitute a meaningful solution to the problem posed. Another approach has been to restrict the rotary motion of the bow string by providing a tensioning line between the bow string and the bow itself. It will be appreciated that the latter arrangement is unsuited to compound bows because of the danger of the tensioning device breaking and injuring the archer's eye.

Accordingly, it is a principal aim of the invention to provide an improved bow sight including improved means for maintaining the desired spacial orientation of the peep sight on the draw string of a compound bow. It is a principal object of the invention so to restrict and safely control any rotational displacement of the draw string that when the bow string is drawn, the sighting bore extending through the peep sight will always be aimed directly at the bow-mounted bow sight, without any lateral deviation and without the need for impairment of accuracy and precision by enlarging the diameter of the bore.

SUMMARY OF THE INVENTION

It is an important feature of the present invention that there is provided an improved string-mounted bow sight and mechanical tensioning and stabilizing means by which objectionable annular twisting of the stranded bow string is obviated, thereby ensuring repetitive consistent alignment of the peep sight bore with the bow-mounted bow sight.

A related feature of the invention is that there is provided a bow string stabilizing and tensioning structure which acts effectively in complete avoidance of mechanical interference caused by intermediate cable strands of a compound bow.

A related feature of the invention is that there is provided a bow string tensioning line which is anchored at one end to the bow string and at its opposite end to a structure other than the bow itself.

An enabling feature of the invention is that there is provided a bow string stabilizing and orienting tensioning line which extends between the bow string itself and an adjacent straight cable segment of the compound bow.

It is an important feature of the peep sight of the invention that there is provided an improved structure by means of which the peep sight is fastened on and carried by the bow string.

A related feature is that the improved structure by which the peep sight is attached to the bow string obviates the need for attaching serving either above or below the position occupied by the peep sight.

Still another feature of the improved mounting structure is that the ease of and capability of shifting and repositioning the peep sight along the bow string is markedly enhanced and simplified.

Conveniently, the peep sight is positioned from about 2" to about 6" from the nocking point.

In a preferred embodiment of the invention the tensioning line which extends between the bow string and the cable segment of the compound bow is attached to the bow string at a position spaced from the peep sight itself, and using an auxiliary bow string-mounted attaching device.

A related advantage of the peep sight and aligning and stabilizing structure of the invention is that, in accordance with the invention, the overall length of the stabilizing or tensioning line is adjustable, and is kept to a practical and advantageous minimum.

All of the features described hereinabove contribute to a markedly improved and highly effectual structure by means of which the improvedly mounted peep sight is repeatedly and reliably brought into precise desired alignment for viewing of the target and/or a bow-mounted bow sight as the bow string is drawn to establish bow string controlling and orienting tension between the bow string and a cable segment of the compound bow. A general structural feature of the peep sight of the invention and the auxiliary components which cooperate to effectuate the purposes of the invention is that all of the components may be readily and simply attached and positioned in place without any need for tools or special equipment of any type, except what may be needed to loosen the string.

An additional practical feature of the components of the present invention is that they are conveniently fabricated of lightweight and highly durable structural materials.

Other and further advantages, features and objects of the invention will become evident upon a consideration of the drawing and the specification.

BRIEF DESCRIPTION OF THE DRAWING

FIG. 3 is a side elevational view, in section, showing the relative positioning and the mode of attachment of the peep sight and aligner of the invention to the bow string, and the aligner tensioning clip to a cable segment of a compound bow;

FIG. 4 is a side view perspective showing the peep sight, peep sight aligner and cable clip and tensioning line, according to the invention, as viewed toward the archer;

FIG. 5 is an elevational view taken substantially on the lines 5—5 of FIG. 3 and showing the peep sight, aligner and clip assembly, as seen by the archer;

FIG. 6 is a plan view showing the tensioning line clip prior to securement to a cable segment of the compound bow;

DESCRIPTION OF PREFERRED EMBODIMENTS

Figure 1:
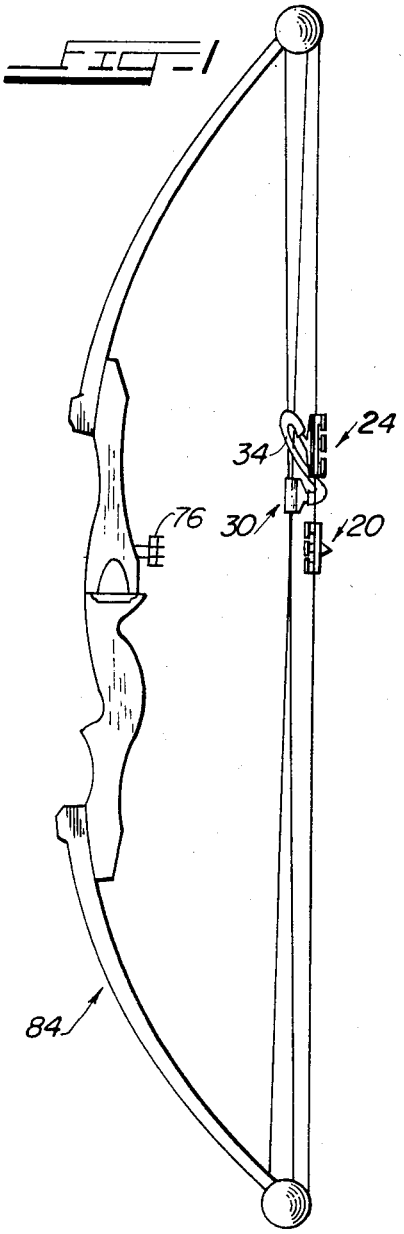
FIG. 1 is a side elevational view of a compound bow, showing the peep sight and aligner attached in accordance with the invention.

The aims and objects of the present invention are achieved by providing, in combination, a peep sight for a compound bow, an improved structure for mounting the peep sight on and securing the peep sight to the bow string, and an adjustable control line or band extending between and interconnecting the bow string and a forwardly spaced cable segment of the compound bow. The resulting physical disposition and interaction of cooperating elements ensures that upon bringing the bow string to full draw, the flexible control line is mildly yet positively tensioned to produce a resultant pulling force on the bow string, the force being operative to urge the bow string and the bow string carried peep sight into a precise, predetermined and reproducible orientational alignment ensuring a desired correlation between a sighting bore in the peep sight and a predetermined reference zone on the bow-mounted bow sight.

The structure by which the peep sight is secured in place on the bow string includes an array of posts integral with the body of the peep sight and projecting therefrom. Attachment of the peep sight is by weaving divided strands of the bow string through the posts to provide tensioned securement of the peep sight in place, and spaced from the aligner.

In a preferred embodiment of the invention, the adjustable control line for establishing tension between the cable segment and the nock-engaging bow string is connected to the bow string by means of a separate, bow string carried aligner, distinct from the peep sight itself, and located at a position spaced from yet near and preferably physically somewhat above the peep sight.

Referring now to the drawings, and particularly to FIGS. 1 through 5, for purposes of disclosure and not in any limiting sense, a preferred embodiment of the invention is shown as comprising, in combination, a bow string mounted peep sight 20, an aligner 24 attached to the bow string 26, a cable clip 30 fastened to a cable 32, and an adjustable band 34 extending between and interconnecting the cable clip 30 with the aligner 24.

Figure 2:
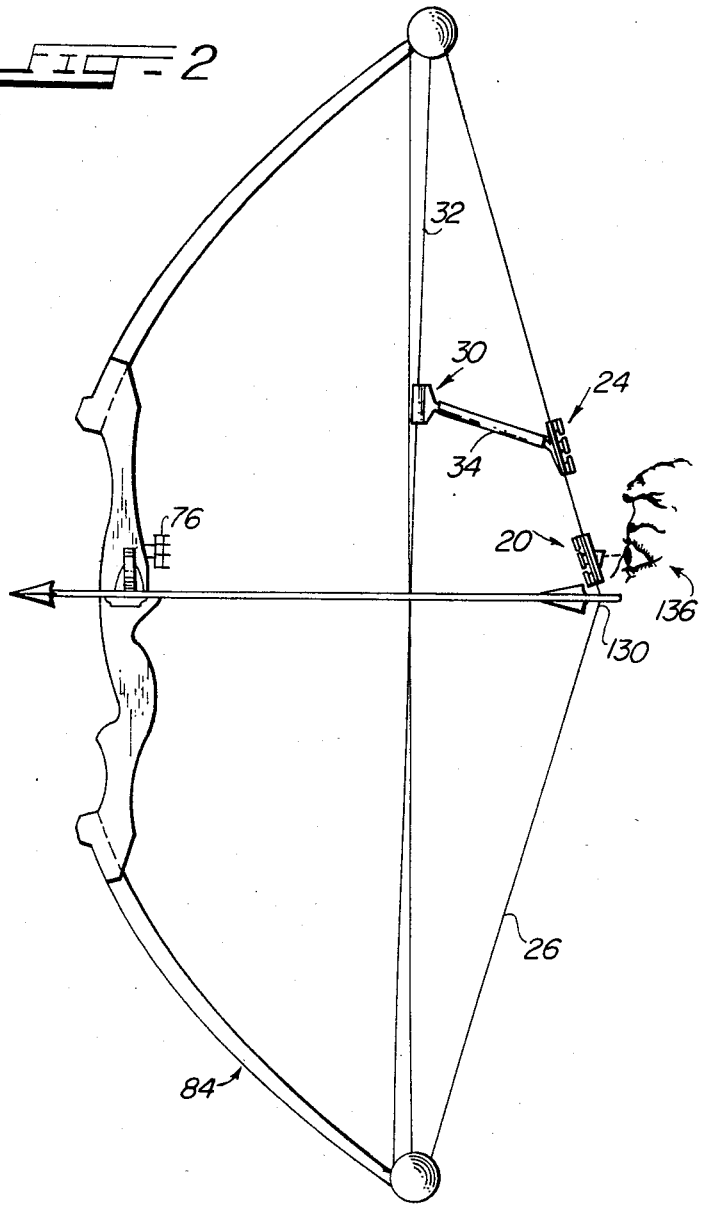
FIG. 2 is a side elevational view of the bow of FIG. 1, but in a drawn position and showing the aligner connected to a cable segment and to the bow string to hold the peep sight in proper orientation.
Figure 15:
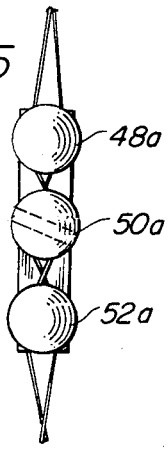
FIG. 15 is a side view of the peep sight of FIG. 12 indicating the manner in which the peep sight is attached to and carried on the bow string.

In one preferred embodiment (FIGS. 3, 4 and 5) the peep sight 20 is in the form of an elongated body 40 having generally planar lateral sides 42 and 44. The body 40 carries a plurality (preferably three or more) of posts 48, 50 and 52 arranged in a linear array. In the specific embodiment shown in FIGS. 3 and 4, the posts 48, 50 and 52 are integrally formed with the body 40 and project forwardly of a forwardly presented surface 56 (away from the archer as the device is used). While each post may be of an essentially identical physical form, in the example depicted in FIGS. 3 and 4, the center post 50 is somewhat larger than the others to accommodate a through orifice or sighting bore 60 formed in to extend through the body 40 of the peep sight 20. At the face 62 opposed to the face 56 carrying the posts 48, 50 and 52, the open end of the through bore 60 is framed by a hood 70 which extends somewhat from the face 62 of the peep sight body 40. The bore 60 is angled upwardly from the rear to the front of the peep sight 20 so that when the bow string 26 is drawn, the bore 60 then assumes an essentially horizontal attitude and bears upon the bow-mounted bow sight 76 (FIG. 2).

The posts 48, 50 and 52 may take any physical form consistent with the utility of serving as a structure about which or through which the divided strands 80 of the bow string 26 of the bow 84 may be woven. As shown in FIG. 3, each post consists of a reduced neck 90 surmounted by and terminating in an enlarged head or cap 94.

Figure 16:
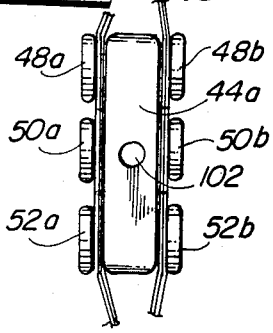
FIG. 16 is a rear elevational view of the peep sight of FIG. 13, secured in position on the supporting bow string, and as viewed by the archer.
Figure 13:
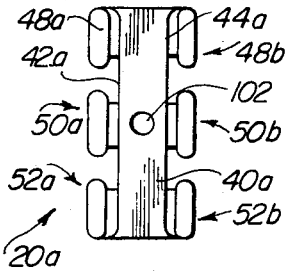
FIG. 13 is a rear elevational view of another peep sight according to the invention.
Figure 14:
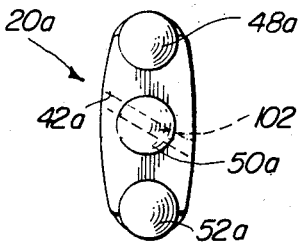
FIG. 14 is a side elevational view of the peep sight of FIG. 13.

In an alternate embodiment of the peep sight 20*a*, as shown in FIGS. 13 through 16, the posts 48*a*, 50*a* and 52*a* and 48*b*, 50*b* and 52*b* project laterally from the body 40*a* of the peep sight 20*a* at opposed sides 42*a* and 44*a* thereof. The sighting bore 102 extends through the body 40*a* (FIGS. 13 and 16).

In yet another embodiment, the peep sight (FIGS. 8 through 12) is constructed so as to include the capability of selectively adjusting the size of the peep hole, or the effective cross sectional area of the viewing bore. As shown in FIGS. 8 through 12, the peep sight 20*b* includes a pair of overlapping plates 104 and 106 which are shiftable relative to one another for defining in a zone bounded by overlapping portions of the plates a peep hole 110 for sighting therethrough.

In the specific form of the plates shown, the overlapping end portions presented toward one another are cut away to define downwardly and upwardly opening V-shaped slots the edges of which serve, together, to frame the peep hole 110. Other end configurations may be used, if preferred.

The plates 104 and 106 are attached to the body 114 of the peep sight 20*b* by fasteners 118, 120, 122 and 124 which can be loosened to permit one plate 104 to slide relative to the other 106, thereby to vary and to adjust the size and the cross sectional configuration of the peep hole 110, toward achieving enhanced sighting accuracy and shooting precision. The plates 104 and 106 are formed with elongated holes 126 to facilitate adjustment.

The fasteners 118, 120, 122 and 124 serve also as the posts about which the divided strands 80 of the bow string 26 are laced to hold the peep sight in the position selected. It will be understood that the position of the peep sight may be readily changed merely be releasing the string tension and sliding the peep sight up or down along the string 26.

The peep sight 20, in whatever physical form elected, is mounted on the bow string 26 at an elevation somewhat above the nocking point or nock position 130 and substantially in line with the archer's aiming eye 136 when the bow string 26 is in a fully drawn mode.

The manner in which the posts 48, 50 and 52 of the peep sight 20 are presented to the bow string 26 is described below in conjunction with a description of the aligner 24 and its securement to the bow string 26.

The aligner 24 of the invention (FIGS. 3 and 4) has an elongate body 146 and a series of posts 150, 152 and 154 generally similar in their overall appearance and structure to that of the posts on the peep sight 20. That is, each post 150, 152 and 154 has a neck 160 projecting from the body 146 of the aligner 24 and surmounted by an enlarged head or cap 166. In the preferred embodiment of the aligner 24 shown in FIGS. 3 and 4, the posts 150, 152 and 154 extend normally from a rearwardly presented face 170 of the body 146 of the aligner 24.

Integral with and projecting forwardly of a front face 172 of the aligner 24 is a rod-like prong or probe 180 for secured attachment to by penetrating into an open end 182 of the adjustable band 34 which, in the preferred embodiment of the assembly shown, takes the form of a rubber or rubber-like tube.

The aligner 24 is fastened on the divided strands 80 of the bow string 26 at a position about one inch above the peep sight 20, as indicated schematically in FIGS. 1 and 2.

A preferred technique for attaching the peep sight 20 and the aligner 24 to the stranded bow string 26 is described with reference to the schematic representation depicted in FIG. 7. Using a string changer or a bow press (not shown) the tension is first released from the bow string 26. The number of strands in the string are then counted and divided into three separate groups or groupings in accordance with the following table, showing the groupings for strings having ten to eighteen strands.

| For Strings Having | Strands Per Group | | |
|---|---|---|---|
| Total Strands | Group 1 | Group 2 | Group 3 |
| 10 | 3 | 5 | 2 |
| 12 | 3 | 6 | 3 |
| 14 | 4 | 7 | 3 |
| 16 | 4 | 8 | 4 |
| 18 | 5 | 9 | 4 |

As an example, FIG. 7 depicts the weaving or winding arrangement for a string having a total of ten strands. As an assist in orientation, the probe 180 of the aligner 24 should be directed upwardly and forwardly when positioned on the string 26, and the hood 70 of the peep sight 20 should be directed downwardly and rearwardly (that is, away from the bow). Also, the hood 70 and the three securement posts or buttons 150, 152 and 154 of the aligner 24 should be on the same side (toward the archer and away from the bow) of the string 26.

Figure 7A:
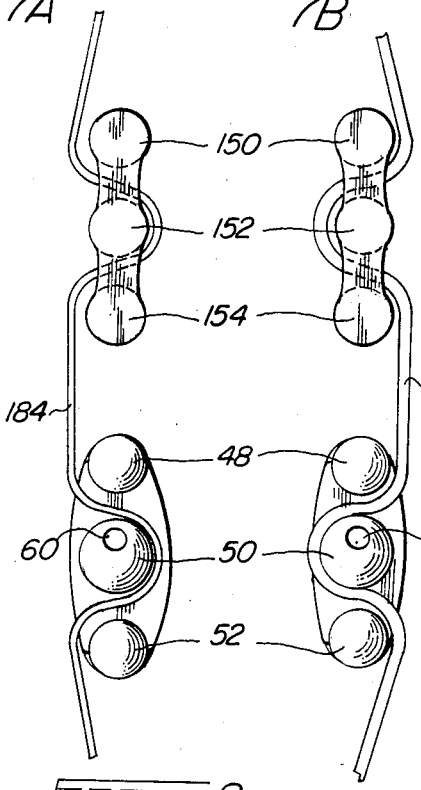
FIGS. 7A, 7B, 7C, and 7D constitute a schematic representation showing the manner in which the divided bow strands of the bow string are laced through or woven around the securement posts of the peep sight and the aligner of the invention.
Figure 7B:
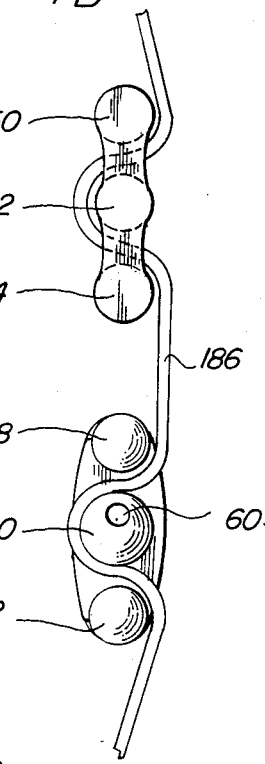
Figure 7C:
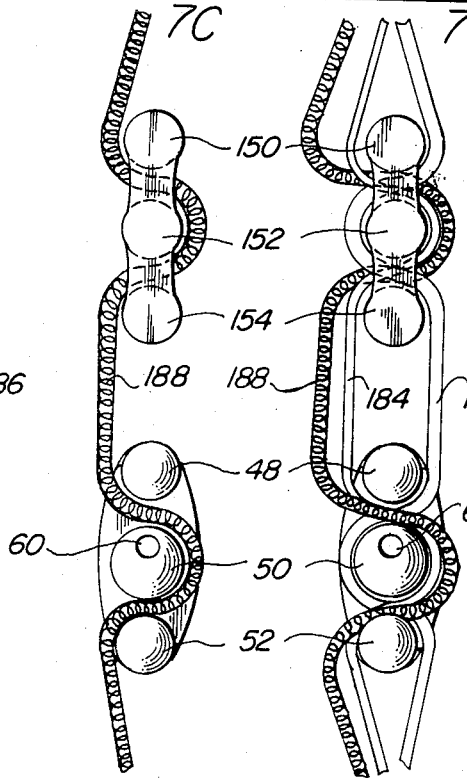
Figure 7D:
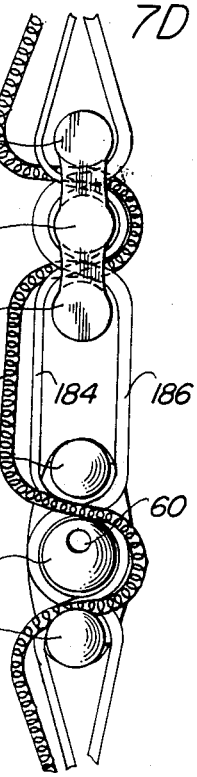
Figure 8:
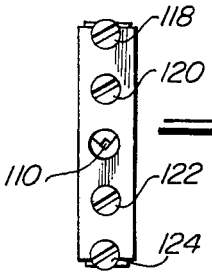
FIG. 8 is a rear elevational view of another preferred embodiment of the peep sight of the invention.
Figure 9:
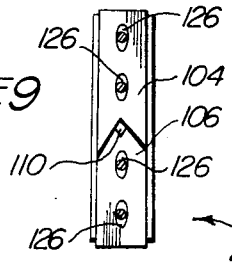
FIG. 9 is a front elevational view of the peep sight of FIG. 8, with the post assemblies removed to show the adjustment slots in the opening-regulating plates.
Figure 10:
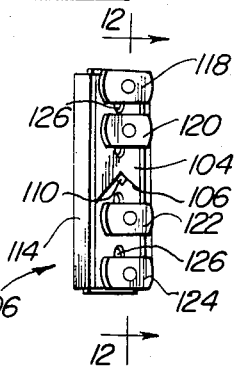
FIG. 10 is a front perspective of the peep sight of FIG. 8 showing the bow string securement posts.
Figure 11:
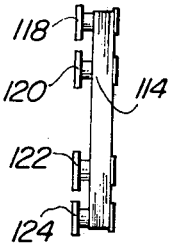
FIG. 11 is a side elevational view of the peep sight of FIG. 8.
Figure 12:
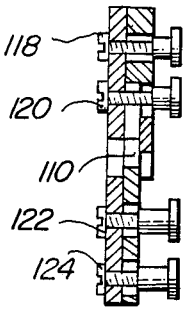
FIG. 12 is a cross sectional view taken substantially on the lines 12—12 of FIG. 10.

Then, the strands 184 (three in number) of Group 1, should be woven, alternately, around the posts 48, 50 and 52 of the peep sight 20 and around the posts 150, 152 and 154 of the aligner 24, following the course shown in FIG. 7A. The second group of strands 186 (five in number) are then woven or wound following the course indicated in FIG. 7B. Finally, the remaining strands 188, Group 3 (two in number) are wound repeating the course followed for Group 1 (see FIG. 7C). As completed, the winding configuration will conform to that indicated schematically in FIG. 7 "FINAL".

As a check on the proper attachment, it should be noted that when the peep sight 20 and the aligner 24 have been properly attached, there will be no crossing strings in the lineal zone between the two attached elements 20 and 24.

Referring now to FIGS. 3, 4 and 6, a preferred embodiment of the cable clip 30 is shown as a bilaterally symmetrical sheet-like web 200 having a central body portion 204 and a pair of in-line, laterally extending arms 208 and 210. The arms 208 and 210 are half-round in cross section with flattened faces presented upwardly. A vertical center line zone 214 of the web 200 is preformed to define a groove-like channel 218 for receiving and grippingly engage a cable segment 222 when the web 200 is folded upon itself around to embrace the cable segment 222, as indicated schematically in FIGS. 3 and 4.

The cable clip 30 is attached to that cable 32 of the compound bow which moves upwardly during drawing of the bow string 26, and at a position about four inches below the aligner prong 180. With the cable clip 30 located as described, and with the aligner 24 in place, a piece of rubber tubing 34 about seven inches in length is attached at one end to the aligner prong 180 and at the other end to the rod-like superimposed arms 208 and 210 of the cable clip 30. With the physical arrangement completed as described, and the tensioning line or tube 34 connected, as the bow string 26 is pulled to a full draw, the band 34 is of a proper length to establish positive tension between the cable 32 and the bow string 26, thereby effecting an alignment of the bow string carried peep sight 20 with the bow carried bow sight 76.

What is claimed is:

1. A sighting assembly including a peep sight for use with a compound bow including a bow string having a plurality of cable segments including a straight cable segment, said peep sight including an elongate body, post means integral with and projecting from said body for coupling with divided strands of a bow string and for shiftably selectively positioning and mounting said peep sight in place on a bow string of a compound bow, said peep sight being formed with bore means for sighting through said body from a rear face thereof toward a target zone, control means for aligning a drawn bow string and for stabilizing and positively positioning the string-mounted said peep sight to orient said body of said peep sight to bring said bore means in said peep sight to extend in a plane paralleling a longitudinal axis of an arrow held in the drawn bow, said control means including band means for establishing a tensioned connection between a forwardly positioned straight cable segment and the drawn bow string of a compound bow, and fastening means for securing opposed ends of said band means respectively to the straight cable segment and to the drawn bow string of the compound bow.

2. The structure as set forth in claim 1 wherein said band means comprises an open-ended tube of an elastomeric composition.

3. The structure as set forth in claim 2 wherein said fastening means for securing an end of said band means to the cable segment includes cable clamping means for grippingly engaging the cable segment of the compound bow, said cable clamping means including integrally formed rod means projecting therefrom for secured insertional engagement within an open end of said elastic tube extending between and connecting the cable segment and the bow string.

4. The structure as set forth in claim 2 wherein said fastening means for securing an end of said band means to the bow string comprises an aligner having an elongate body, and further comprising a plurality of post means integrally formed with said body and projecting therefrom for stressingly engaging divided tensioned strands of a bow string woven through said post means in gripping relation therewith, and rod-like probe means integral with and extending forwardly from said body for secured insertional engagement within an open end of said tube extending between and connecting the bow string and the cable segment.

5. The structure as set forth in claim 3 wherein said cable clamping means comprises a deformable, bilaterally symmetrical sheet including a central body portion and a pair of in-line elongated arms extending laterally therefrom, said body portion being foldable along a vertical center line to bring said arms into a superimposed disposition while simultaneously bringing opposed halves of said body portion toward one another grippingly to embrace therebetween a cable segment to which said cable clamping means is to be fastened.

6. The structure as set forth in claim 5 wherein said central body portion of said sheet is preformed to define a vertically extending groove-like mid-line channel for grippingly seating the cable segment therewithin.

7. The structure as set forth in claim 1 wherein said post means of said peep sight comprises a series of posts spaced along said elongate body, each of said posts defining a radially enlarged head surmounting a reduced neck integral with and projecting from said body.

8. The structure as set forth in claim 1 wherein said bore means includes a passage extending through the body of said peep sight at an angle directed downwardly as viewed toward an archer using the bow.

9. The structure as set forth in claim 1 wherein said post means define spaced posts extending as an in-line series along the body of said peep sight, said posts being adapted sequentially to engage thereagainst in tensioned contact therewith divided strands of the bow string woven through said posts.

10. The structure as set forth in claim 4 wherein said probe means extends from a fowardly presented face of said body of said connector and wherein said probe means is angled forwardly and upwardly as viewed by an archer using the bow.

11. The structure as set forth in claim 7 wherein said posts extend laterally from said body at opposed sides thereof.

12. The structure as set forth in claim 7 wherein said posts extend normally of said body at a rearwardly presented face thereof presented toward an archer using a bow.

13. The structure as set forth in claim 8 and further comprising hood means overlying said passage for shielding said passage at an end thereof presented to an archer using the bow.

14. The structure as set forth in claim 13 wherein said hood means is angled downwardly from a rear face of said body of said peep sight as viewed toward an archer using the bow.

15. The structure as set forth in claim 13 wherein said fastening means for securing an end of said band means to the bow string comprises a connector having an elongate body including a plurality of post means integrally formed with said body for stressingly engaging divided tensioned strands of a bow string woven through said post means in gripping relation therewith, and wherein said post means carried by said connector extend from a face thereof which is presented in a direction in correspondence with a direction in which said hood means extends.

16. The structure as set forth in claim 1 wherein said forwardly positioned straight cable segment is a cable segment that moves upwardly as the bow string is drawn.

17. The structure as set forth in claim 7 and further comprising overlapping plate means carried by said peep sight, said plate means being shiftable relative to one another for defining at physically adjacent zones thereof a peep hole of said peep sight for sighting therethrough, said plate means being positionable relative to one another to vary and selectively to adjust the cross-sectional configuration and area of said peep hole for achieving lesser and greater sighting precision, and locking means operable upon said plate means to hold said plate means in selectable positions correlated with particular preferred peep hole configurations.

18. The structure as set forth in claim 17 wherein said plate means are physically disposed to include overlapping terminal portions including cut away zones defining open ended, generally V-shaped slots with open ends of said slots being presented toward one another, and wherein bounding edges of said slots serve together to characterized and to frame said peep hole in said peep sight.

* * * * *